US005582018A

United States Patent [19]

Black et al.

[11] Patent Number: 5,582,018

[45] Date of Patent: Dec. 10, 1996

[54] METHOD FOR PREVENTING FORMATION OF ICE SLUSH IN AN ICE MAKER

[75] Inventors: William J. Black, Gurnee; Mark A. McKinney, Lindenhurst; Matt W. Allison, Gurnee, all of Ill.

[73] Assignee: Scotsman Group, Inc., Vernon Hills, Ill.

[21] Appl. No.: 520,623

[22] Filed: Aug. 30, 1995

[51] Int. Cl.[6] ..... F25C 1/12

[52] U.S. Cl. ..... 62/74; 62/347

[58] Field of Search ..... 62/74, 347

[56] References Cited

U.S. PATENT DOCUMENTS

| | | | |
|---|---|---|---|
| 4,785,641 | 11/1988 | McDougal | 62/233 |
| 4,884,413 | 12/1989 | Quandt et al. | 62/135 |
| 4,907,415 | 3/1990 | Stewart, Jr. et al. | 62/347 |
| 5,402,650 | 4/1995 | Stewart, Jr. | 62/347 |

*Primary Examiner*—William E. Tapolcai
*Attorney, Agent, or Firm*—Harness, Dickey & Pierce

[57] ABSTRACT

A method for preventing the formation of icy slush within the sump of an ice maker. The method includes the steps of monitoring the temperature of the water being circulated through the ice maker and detecting when the temperature reaches about 32° F. When the water reaches about 32° F., the water pump is turned-off to allow residual water on evaporator plates of the ice maker to freeze and form ice crystals thereon. The water pump is turned-off for a predetermined period of time sufficient to allow the residual water remaining on the evaporator plates to freeze, which is preferably about 40 seconds, before it is turned back on. Thereafter, circulating water gradually freezes to the ice crystals formed on the evaporator plates. This prevents the water in the sump from cooling below about 32° F. which would cause an icy slush to form in the sump. The above cycle is repeated after ice is harvested from the evaporator plates.

13 Claims, 3 Drawing Sheets

METHOD FOR PREVENTING FORMATION OF ICE SLUSH IN AN ICE MAKER

BACKGROUND OF THE INVENTION

1. Technical Field

This invention relates to ice makers, and more particularly to a method for preventing the formation of ice slush in a water reservoir of the ice maker.

2. Discussion

Ice makers have traditionally been susceptible to a formation of ice slush in the water reservoir thereof. Ice slush occasionally forms when the water pump of the ice maker continues to pump water through and over various internal components of the ice maker, and particularly via evaporator plates thereof, while the compressor of the ice maker is running. As the water continuously circulates over the evaporator plates of the evaporator, the water continues to drop in temperature to just less than about 32° F. where it becomes what is termed in the art as "sub-cooled".

Once the water is cooled down to just below about 32° F., the water will suddenly form a slush-like mixture of ice and water. This icy slush cannot be pumped by the water pump of the ice maker and thus causes the flow of water through the various components of the system to be interrupted. Prior attempts at ameliorating this build-up of icy slush in an ice maker have shown limited or inconsistent results. One such attempt has involved delaying the turn-on of the water pump after a harvest cycle in an effort to allow the evaporator plates to become super-cooled. It was thought that allowing the evaporator plates to super-cool, and then causing a brief charge of water to be distributed over the evaporator plates would provide some initial formation of ice on the evaporator plates, which would help to allow sub-cooled water to become frozen to the evaporator plates. Another attempt involved injecting fresh water into the sump when the temperature of the water in the sump became less than about 32° F. As stated above, such attempts have proven only marginally successful in reducing the frequency of icy slush build-up in ice makers.

Accordingly, it is a principal object of the present invention to provide a control method for controlling and eliminating the build-up of icy slush in an ice maker which would otherwise interfere with the function of the ice maker in producing ice.

More particularly, it is the principal advantage of the present invention to provide a method for controlling the circulation of water within an ice maker in a manner to allow residual water left on the evaporator plates to freeze and form ice crystals thereon while the flow of water through the various components of the ice maker has been interrupted.

It is yet another object of the present invention to controllably interrupt the flow of water through the various components of an ice maker for a predetermined period of time, thereby allowing residual water residing on the evaporator plates of the evaporator of the ice maker to freeze and form ice crystals thereon.

It is still another object of the present invention to restart the water pump of the ice maker only after a predetermined period of time has elapsed in which the water pump of the ice maker has been turned-off, such that water in the ice maker (i.e., water at or near 32° F.) will freeze to the ice crystals formed on the evaporator plates. When ice crystals are present, circulating water cannot sub-cool to below about 32° F. because any such water will quickly freeze to the ice crystals formed on the evaporator plates, thus preventing the formation of an icy slush in the water reservoir of the ice maker.

It is still another object of the present invention to provide a method for eliminating the formation of icy slush in the water reservoir of an ice maker without adding expensive equipment to an ice maker, and to make use of existing components of the ice maker to carry out the method of the present invention.

SUMMARY OF THE INVENTION

The above and other objects are provided by a preferred method for preventing the formation of icy slush in accordance with the present invention. The preferred method generally involves monitoring the temperature of water circulating through the various components of an ice maker and determining when the circulating water has dropped to an actual temperature of about 32° F. When this occurs, a water pump of the ice maker is turned-off for a predetermined period of time. This period of time may vary considerably depending upon various factors, but preferably is between about 20 seconds and 40 seconds, and more preferably about 40 seconds.

During the time in which the water pump is turned-off, residual water remaining on the evaporator plates of the evaporator of the ice maker freezes and forms ice crystals on the evaporator plates. After the predetermined period of time has expired, the water pump is again turned-on and water begins circulating through the various components of the ice maker. As the water passes over the evaporator plates, water that is near about 32° F. freezes to the ice crystals. In effect, the ice crystals serve to prevent water from becoming sub-cooled to eliminate the formation of icy slush in the sump of the ice maker which would be impossible to pump through the various components of the ice maker.

Once it is detected that the level of water in the sump has dropped to a predetermined level, thus indicating that fully formed ice cubes are present on the evaporator, the ice is harvested. During the harvesting process, water is admitted into the sump to refill the sump to a predetermined level. Thereafter, the above-described cycle repeats and the water pump is again turned-off when it is detected that the actual temperature of the water circulating through the ice maker has dropped to about 32° F.

The above-described method requires little in the way of additional equipment for an otherwise conventional ice maker, does not add appreciably to the overall cost of the ice maker, and it serves to completely eliminate the problem of icy slush formation in the sump of an ice maker.

Still further, the preferred method of the present invention does not add appreciably to the cost of the overall ice maker, to its overall outer dimensions, and does not significantly increase the complexity of construction of the ice maker.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
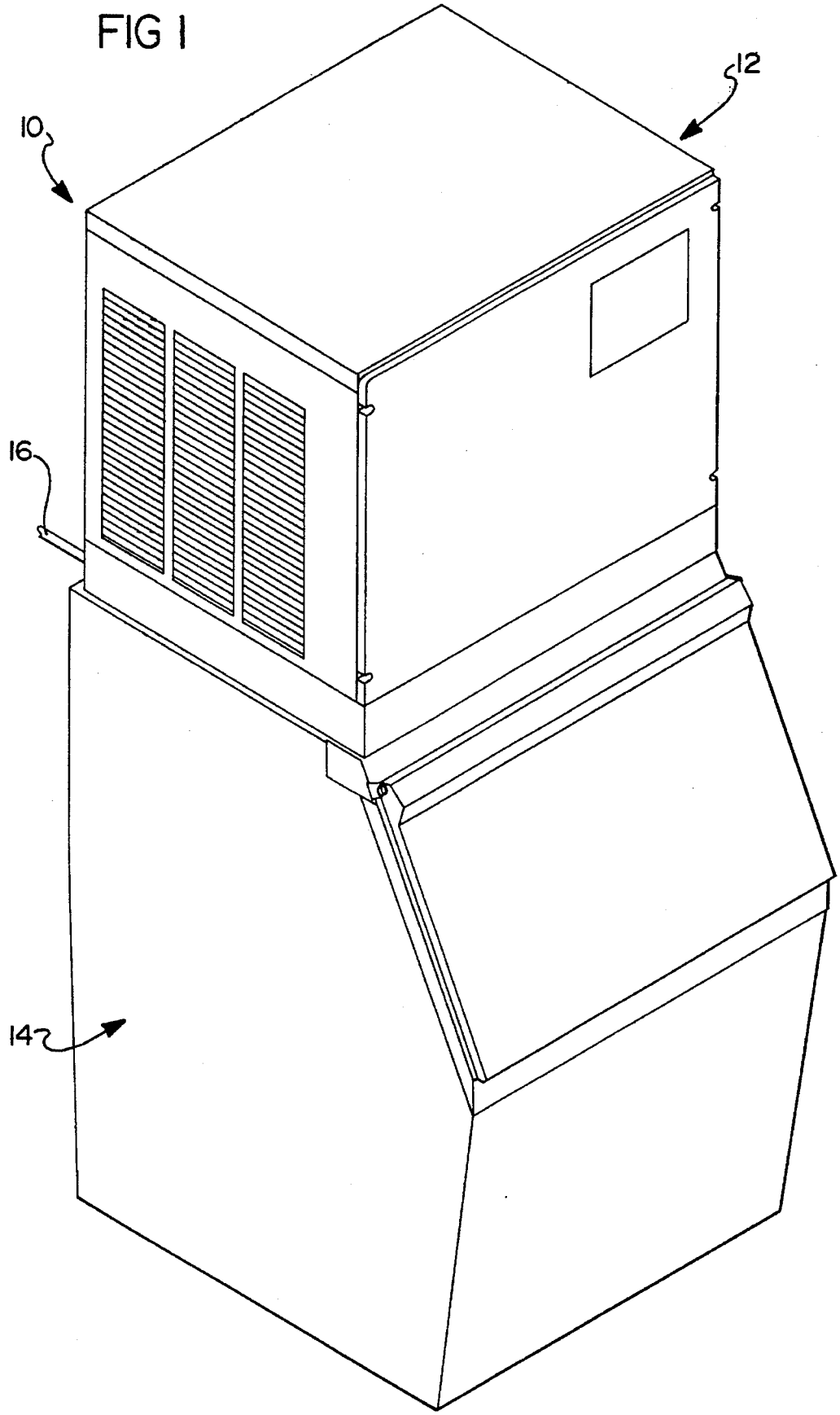
FIG. 1 is a perspective view of an ice maker incorporating the method of the present invention.

Referring to FIG. 1, there is shown an ice maker 10 incorporating the method of the present invention. The ice maker 10 generally comprises an ice forming section 12 and an ice bin 14 for collecting ice produced by the ice making section 12. A water line 16 supplies water to the ice maker 10. It will be appreciated immediately, however, that while the ice maker 10 has been shown as having a simple ice bin, that the ice maker 10 could also include drink dispensing equipment to provide ice and drink dispensing capabilities.

Figure 2:
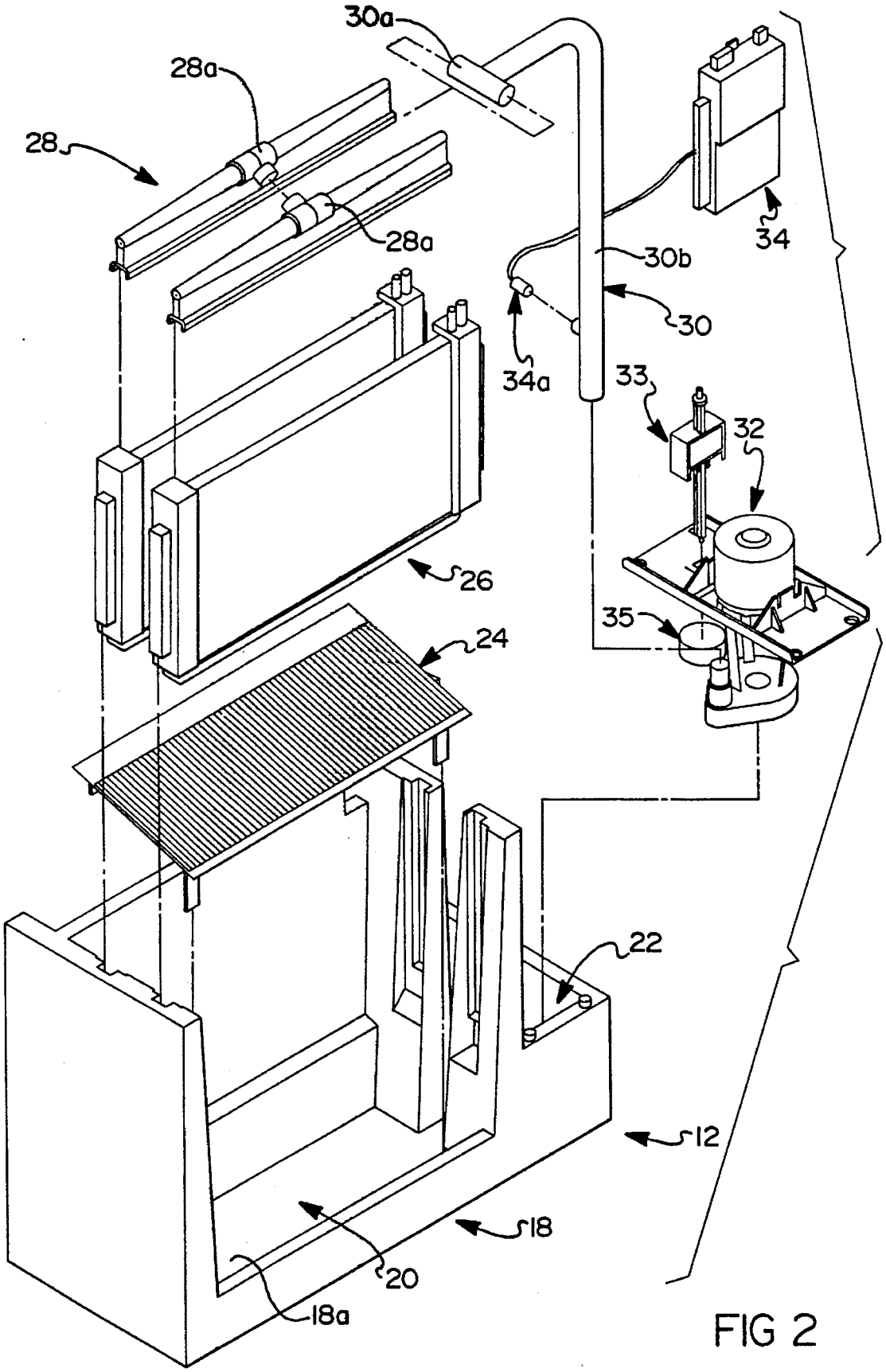
FIG. 2 is an exploded perspective view of several of the major components of the ice maker in FIG. 1.

With reference to FIG. 2, the major subcomponents of the ice making section 12 are shown. The ice making section 12 generally includes a housing 18 having a first compartment 20 and a second compartment 22. The first compartment houses therein an ice cube deflector 24, a plurality of evaporator plates 26 and a water distributor assembly 28. Coupled to the water distributor assembly 28 is a water supply tube 30 which is intercoupled with T-shaped coupling portions **28*a* of the water distributor 28 at a head portion 30*a* thereof. The water supply tube 30 also includes an elongated neck portion 30*b* which is coupled to a water pump 32 disposed in the second compartment 22 of the housing 18. Also, operably associated with the water pump 32 is a sump level control 33 and a float 35**.

With further reference to FIG. 2, the sump level control 33 operates to signal a drop in the level of water held within a sump portion **18*a* of the housing 18. The water supply tube 30 has associated therewith a water temperature probe 34*a* of an electronic control 34 for monitoring the temperature of water circulated through the water supply tube 30**.

Figure 5:
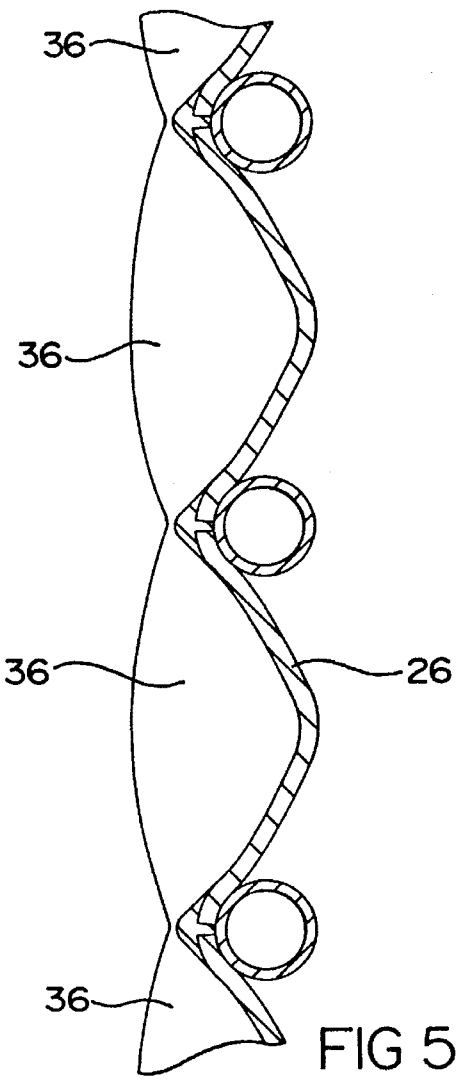
FIG. 5 is a view of the evaporator showing ice formed on the evaporator at harvest.
Figure 4:
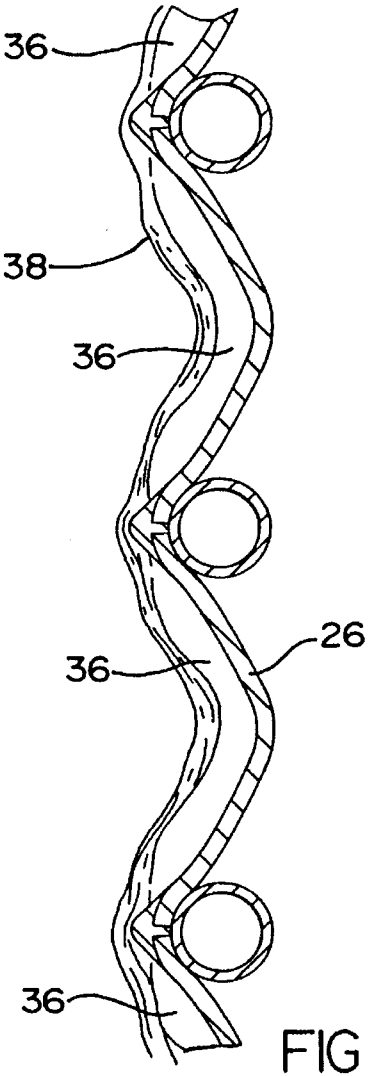
FIG. 4 is a view of the evaporator plate of FIG. 3 showing the continued formation of ice crystals thereon after the circulation of water in the ice maker has been resumed and as water at about 32° F. passes over the evaporator plate.
Figure 3:
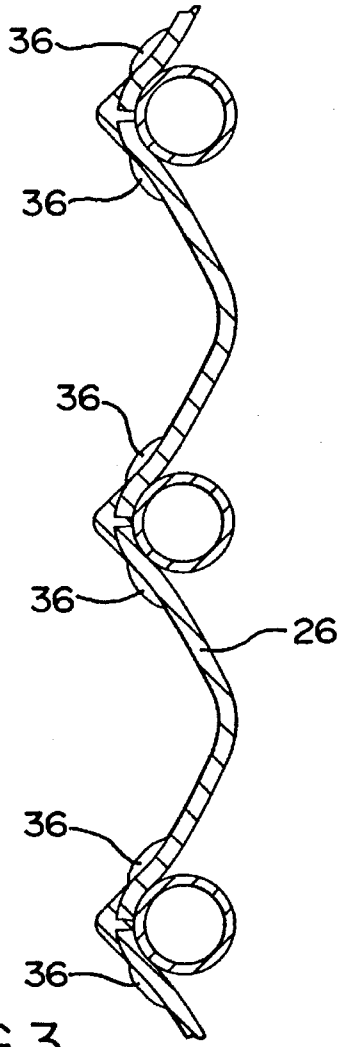
FIG. 3 is a view of a portion of one evaporator plate of the ice maker in FIG. 1 showing the formation of ice crystals from residual water thereon after the circulation of water has been interrupted.

Referring now to FIGS. 3–5, the preferred method of controlling the formation of icy slush within the ice maker 10 of FIG. 1 will be described. Initially, however, it will be appreciated that the preferred method of the present invention accomplishes preventing the formation of icy slush within the sump **18*a* (FIG. 2**) without the need for extensive additional and expensive equipment. Furthermore, the preferred method of the present invention accomplishes preventing the formation of icy slush without materially interfering with the operation of the ice maker and its efficiency in producing cubed ice.

Referring now to FIGS. 2 and 3, as the ice maker 10 operates the water pump 20 pumps water from the sump **18*a* of the housing 18 up through the water supply tube 30 and into the water distributor 28. The water flows over the evaporator plates 26 and then returns to the sump 18*a*. While the water is circulating, the water is being cooled as it flows over the evaporator plates 26 and its temperature is continuously monitored by the water temperature probe 34*a* and the electronic control 34. It will be appreciated that the electronic control 34** is a commercially available control available from the assignee of the present application.

As the water flows through the water supply tube 30, the water temperature probe **34*a* continuously monitors the temperature of the flowing water and sends a voltage signal to the electronic control 34 representative of the water temperature at any given time. As the water continues to circulate through the components of the ice maker 10, the water becomes cooler and cooler as it is recirculated over the evaporator plates 26, which are being cooled in conventional fashion by a compressor (not shown). As the water continues to recirculate through the components of the ice making section 12, the water continues to drop in temperature each time it passes over the evaporator plates 26. If the water is allowed to cool down to a temperature below about 32° F., then the water begins to form an icy slush in the sump 18*a* which can not be pumped readily through the components of the ice making section 12**.

To prevent the water in the ice making section 12 from forming an icy slush, the electronic control 34 is used to turn off the water pump 20 once the water temperature probe **34*a* senses that the temperature of the water circulating through the water supply tube 30 has dropped to a sensed temperature of about 38° F. (corresponding to an actual temperature of about 32° F.). The electronic control 34** maintains the water pump turned-off for a predetermined period of time, preferably about 20 seconds to about 60 seconds, and more preferably for about 40 seconds.

With reference to FIG. 3, during the time that the water pump 32 is turned-off, residual water left on the evaporator plates 26 freezes and forms ice crystals 36 thereon. After the predetermined period of time has expired, the electronic control 34 signals the water pump 32 to turn on and the water pump again begins recirculating water from the sump **18*a* through the water supply tube 30, through the water distributor 28 and over the evaporator plates 26. As water at or near about 32° F. circulates over the evaporator plates 26, as indicated by reference numeral 38 in FIG. 4, it freezes to the ice crystals 36 and the ice crystals 36 begin to grow. Put differently, the prior formation of the ice crystals 36 on the evaporator plates 26 enables water at or near a temperature of about 32° F. to freeze more readily to the evaporator plates, which prevents the circulating water from becoming sub-cooled (i.e., cooled to below about 32° F.), and from forming an icy slush in the sump 18*a* of the housing 18. Thus, as the water 38 is recirculated through the various components of the ice making section 12, and particularly over the evaporator plates 26, the temperature of the water circulating through the components of the ice making section 12 is maintained at an actual temperature of about 32° F. This, in turn, prevents the water in the sump 18*a* from becoming sub-cooled (i.e., cooled below about 32° F.) which would otherwise cause the water to turn to icy slush. During the time that the water pump 32 is causing water 38 to be circulated, the ice crystals 36 continue to grow until they become fully formed ice cubes ready for harvest, as shown in FIG. 5**.

With further reference to FIGS. 2 and 5, once the sump level control 33 detects that the level of water in the sump **18*a* has dropped to a predetermined level, this indicates that fully formed cubes of ice are present on the evaporator plates 26 (as shown in FIG. 5). The ice formed on the evaporator plates 26 is then harvested, preferably using a hot gas bypass system in which the evaporator plates 26 are warmed to a temperature above 32° F. This causes the ice cubes formed on the evaporator plates 26 to fall onto the cubed deflector 24 and into the ice bin 14 (FIG. 1). During this harvesting step, the electronic control 34 signals a conventional fluid flow valve (not shown) to admit water from the water line 16**

(FIG. 1) into the sump 18*a*. The float 35 indicates to the sump level control 33 when the sump 18*a* is full.

Once the harvesting of ice is complete, the electronic control 34 again signals the water pump 32 to turn on and begin pumping water through the various components of the ice making section 12. Once the circulating water is cooled down to a sensed temperature of about 38° F. (corresponding to an actual temperature of about 32° F.), the electronic control 34 again causes the water pump 32 to be turned-off for the predetermined period of time (i.e., preferably about 40 seconds), and the steps of allowing residual water remaining on the evaporator plates 26 to freeze to ice crystals 36, and then resuming the circulation of water over the evaporator plates 26 is repeated until fully formed ice cubes are present on the evaporator plates 26 and ready to be harvested.

It will be appreciated that while the preferred off-time for the water pump 32 described above has been determined to be in most instances between about 20 seconds to about 60 seconds, and more preferably about 40 seconds, that this figure may vary in accordance with the specific ice maker with which the method of the present invention is implemented. The key element is that the "off" period be sufficiently long to allow residual water remaining on the evaporator plates 26 to freeze into ice crystals 36 before the water pump 32 is again turned-on.

The preferred methods of the present invention thus enable the formation of icy slush within the sump 18*a* of the ice making section 12 to be eliminated without materially reducing the efficiency of the ice making section 12. The preferred methods of the present invention further enable the formation of icy slush to be prevented without the need for adding significant, expensive equipment to the ice making section 12 which would otherwise significantly increase the overall cost of the ice maker 10 and/or increase its overall outer dimensions appreciably. The preferred methods of the present invention, most importantly, enable the ice maker 10 to operate without incurring the problem of icy slush forming in the sump 18*a*, which would negatively affect its efficiency.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A method for preventing the formation of icy slush in a water reservoir of an ice maker, said method comprising the steps of:

filling said water reservoir with a predetermined amount of water;

causing said water to be pumped over at least one plate of an evaporator of said ice maker by a water pump;

monitoring the temperature of said water;

when said water is cooled down to a predetermined temperature, causing said water pump to turn off for a predetermined period of time until residual water remaining on said plate of said evaporator freezes to form ice crystals thereon; and after said predetermined period of time has expired, turning on said water pump to again cause water to be circulated over said plate of said evaporator, whereby said ice crystals facilitate the freezing of water flowing over said evaporator plates, thereby preventing said circulating water from cooling to a temperature below about 32° F., and thereby preventing the formation of said icy slush in said reservoir.

2. The method of claim 1, further comprising the step of monitoring the amount of ice formed on said plate of said evaporator; and after a predetermined amount of ice is formed on said plate of said evaporator, harvesting said ice on said plate by causing said plate to be warmed to a temperature above approximately 32° F., whereupon ice cubes formed on said plate of said evaporator are released and deposited in a storage bin of said ice maker.

3. The method of claim 1, wherein said predetermined time period comprises a time period between approximately 20 seconds to about 60 seconds.

4. The method of claim 3, wherein said predetermined time period comprises a time of approximately 40 seconds.

5. The method of claim 1, wherein said water pump of said ice maker is turned-off when said water temperature is measured to be about 38° F.

6. The method of claim 2, further comprising the steps of causing said water reservoir to be refilled with water after said ice cubes are harvested from said evaporator plate;

continuing to monitor said temperature of said water, as said water flows over said plate of said evaporator;

again turning off said water pump when said temperature of said water is cooled down to said predetermined temperature; and keeping said water pump turned-off for said predetermined period of time.

7. A method for preventing the formation of icy slush in a water reservoir of an ice maker, said method comprising the steps of:

filling said water reservoir with an amount of water;

causing said water to be pumped over at least one evaporator plate of said ice maker;

interrupting the circulation of water for a predetermined time interval to allow residual water remaining on said evaporator plate to freeze and form ice crystals on said evaporator plate; and resuming the circulation of water over said evaporator plate, whereby said water flows over said evaporator plate, said ice crystals formed thereon facilitate the freezing of said water to said evaporator plate and prevent said water from cooling to a temperature below about 32° F., to thereby prevent the formation of said icy slush in said reservoir.

8. The method of claim 7, wherein said circulation of water is interrupted for a period of between about 20 seconds to about 60 seconds.

9. The method of claim 8, wherein said circulation of said water is interrupted for a time of about 40 seconds.

10. A method for preventing the formation of icy slush in a water reservoir of an ice maker, said method comprising the steps of:

circulating water from a water reservoir over an evaporator plate of said ice maker;

interrupting the circulation of said water over said evaporator plate for a desired time interval sufficient to enable residual water remaining on said evaporator plate to freeze and form ice crystals on said evaporator plate; and after said desired time interval has expired, resuming the circulation of water over said evaporator plate, whereby said ice crystals facilitate the freezing of said water to said evaporator plate to prevent circulating water from cooling to a temperature below about 32° F. to thus prevent the formation of said icy slush.

11. The method of claim 10, wherein said desired time and removal is approximate 20 seconds to about 60 seconds.

12. The method of claim 11, wherein said desired time interval comprises a time of approximately 40 seconds.

13. The method of claim 10, further comprising the step of harvesting ice formed on said evaporator plate once a level of said water in said reservoir drops to a determined level.

* * * * *